US007286444B1

(12) United States Patent
Bahder et al.

(10) Patent No.: US 7,286,444 B1
(45) Date of Patent: Oct. 23, 2007

(54) METHOD AND SYSTEM FOR SYNCHRONIZING SEPARATED CLOCKS

(75) Inventors: Thomas B. Bahder, Clarksville, MD (US); William M. Golding, Bowie, MD (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 287 days.

(21) Appl. No.: 10/926,064

(22) Filed: Aug. 26, 2004

Related U.S. Application Data

(60) Provisional application No. 60/499,411, filed on Aug. 26, 2003.

(51) Int. Cl.
*G04C 11/02* (2006.01)

(52) U.S. Cl. ..... 368/47; 250/336.1; 375/355

(58) Field of Classification Search ..... 368/47, 368/46, 48, 52–61
See application file for complete search history.

(56) References Cited

U.S. PATENT DOCUMENTS

| | | | | |
|---|---|---|---|---|
| 5,917,322 | A | 6/1999 | Gershenfeld et al. | 324/307 |
| 6,473,719 | B1 | 10/2002 | Steenblik | 702/181 |
| 7,072,432 | B2 * | 7/2006 | Belcea | 375/356 |
| 2002/0097874 | A1 * | 7/2002 | Foden et al. | 380/256 |
| 2002/0163466 | A1 * | 11/2002 | Jin | 342/356 |

OTHER PUBLICATIONS

Samain : Time Transfer by Laser Lin (T2L2) experiment on Mir; Metrologia, 1998, 35, pp. 151-159.*

Article by D. Branning, A. L. Midgall and A. V. Sergienko, entitled "Simultaneous measurement of group and phase delay between two photons", Physical Review A, vol. 62, published Nov. 10, 2000, pp. 063808-1-06380812.

Article by D. Branning, W. P. Grive, R. Erdmann and I. A. Walmsley, entitled "Engineering the Indistinguishability and Entanglement of Two Photons", Physical Review Letters, vol. 83, No. 5, dated Aug. 2, 1999, pp. 955-958.

Article by T. B. Pittmann, D. V. Strekalov, A. Migdall, M. H. Rubin, A. V. Sergienko and Y. H. Shih, entitled "Can Two-Photon Interference be Considered the Interference of Two Photons?", Physical Review Letters, vol. 77, No. 10, dated Sep. 2, 1996, pp. 1917-1920.

Article by Hong, et al., entitled "Measurement of Subpicosecond Time Intervals Between Two Photons by Interference," Physical Review Letter, vol. 59, No. 18, dated Nov. 2, 1987.

* cited by examiner

*Primary Examiner*—Vit Miska
*Assistant Examiner*—Sean Kayes
(74) *Attorney, Agent, or Firm*—Edward L. Stolarun

(57) ABSTRACT

Methods and systems for synchronizing a first clock with a second clock, wherein the clocks are separated, are disclosed. A representative system, among others, includes a correlated particle emitter that emits a first particle stream and a second particle stream. Particles in the first particle streams are quantum mechanically correlated with particles in the second particle stream. The system also includes: a first target having the first clock and a first particle detector, and a second target having the second clock and a second particle detector. The first target uses the first clock and the first particle detector to determine arrival times of particles included in the first particle stream, and the second target uses the second clock and the second particle detector to determine arrival times of particles included in the first particle stream.

26 Claims, 6 Drawing Sheets

METHOD AND SYSTEM FOR SYNCHRONIZING SEPARATED CLOCKS

CROSS-REFERENCE TO RELATED APPLICATION

This application claims priority to copending U.S. provisional application entitled, "Method For Accurate Time Transfer, Clock Synchronization, And Navigation In Curved Space-Time," having Ser. No. 60/499,411, filed 26 Aug., 2003, which is entirely incorporated herein by reference.

GOVERNMENT INTEREST

The invention described herein may be manufactured and used by or for the United States Government for governmental purposes without the payment of any royalties thereon.

BACKGROUND

1. Technical Field

The present invention is generally related to the synchronization of clocks that are separated.

2. Description of the Related Art

High-accuracy synchronization of clocks plays an important role in fundamental physics and in a wide range of applications such as communications, message encryption, navigation, geolocation and homeland security. A classical method of time synchronization of spatially separated clocks is Eddington slow clock transport. In this approach, two co-located clocks are initially synchronized, and then one of the clocks is slowly transported to another location to synchronize with a distant clock, i.e., a geographically separated clock. For most technological applications, this method is not practical because it requires transport of hardware, i.e., the clock, as well as conflicting requirements: on the one hand, clock transport must be slow to reduce the relativistic effect of time dilation, but on the other hand, the transport must be fast enough so that significant time differences do not accrue from unavoidable timing errors due to the limited frequency stability of the transported clock's mechanism or due to gravitational potential differences along the path of the transported clock.

Today, in practical applications, a satellite system, such as the Global Positioning System (GPS), is used for synchronizing two spatially separated clocks. GPS is a satellite system in which signals are sent from satellite-to-ground and from ground-to-satellite to synchronize the satellite clocks with a master clock on the Earth. The time-synchronization accuracy provided by a GPS receiver is on the order of 20 nanoseconds (ns). However, there are applications, such as coherent detection of high-frequency electromagnetic signals, where time synchronization is required to an accuracy that cannot be provided by GPS. Therefore, there exists a need for synchronizing spatially separated clocks to an accuracy better than the nanosecond range

SUMMARY

Systems and methods for synchronizing a first clock with a second clock, wherein the clocks are separated, are disclosed. A representative system, among others, includes a correlated particle emitter that emits a first particle stream and a second particle stream. Particles in the first particle stream are quantum mechanically correlated with particles in the second particle stream. The system also includes: a first target having the first clock and a first particle detector, and a second target having the second clock and a second particle detector. The first target uses the first clock and the first particle detector to determine arrival times of particles included in the first particle stream, and the second target uses the second clock and the second particle detector to determine arrival times of particles included in the second particle stream.

An embodiment of a method can be broadly summarized by the following steps: transmitting along a first particle path a first stream of particles to a target having the first clock; transmitting along a second particle path a second stream of particles to a second target having the second clock; determining an offset for the first clock based upon arrival times of particles in the first stream of particles at the first target and upon arrival times of particles in the second stream of particles at the second target; and applying the offset to the first clock.

Other systems, methods, features, and/or advantages will be or may become apparent to one with skill in the art upon examination of the following drawings and detailed description. It is intended that all such additional systems, methods, features, and/or advantages be included within this description and be protected by the accompanying claims.

BRIEF DESCRIPTION OF THE DRAWINGS

The components in the drawings are not necessarily to scale. Moreover, in the drawings, like reference numerals designate corresponding parts throughout the several views.

DETAILED DESCRIPTION

It should be emphasized that the above-described embodiments are merely possible examples of implementations. Many variations and modifications may be made to the above-described embodiments. All such modifications and variations are intended to be included herein within the scope of this disclosure and the present invention and protected by the following claims.

Figure 1:
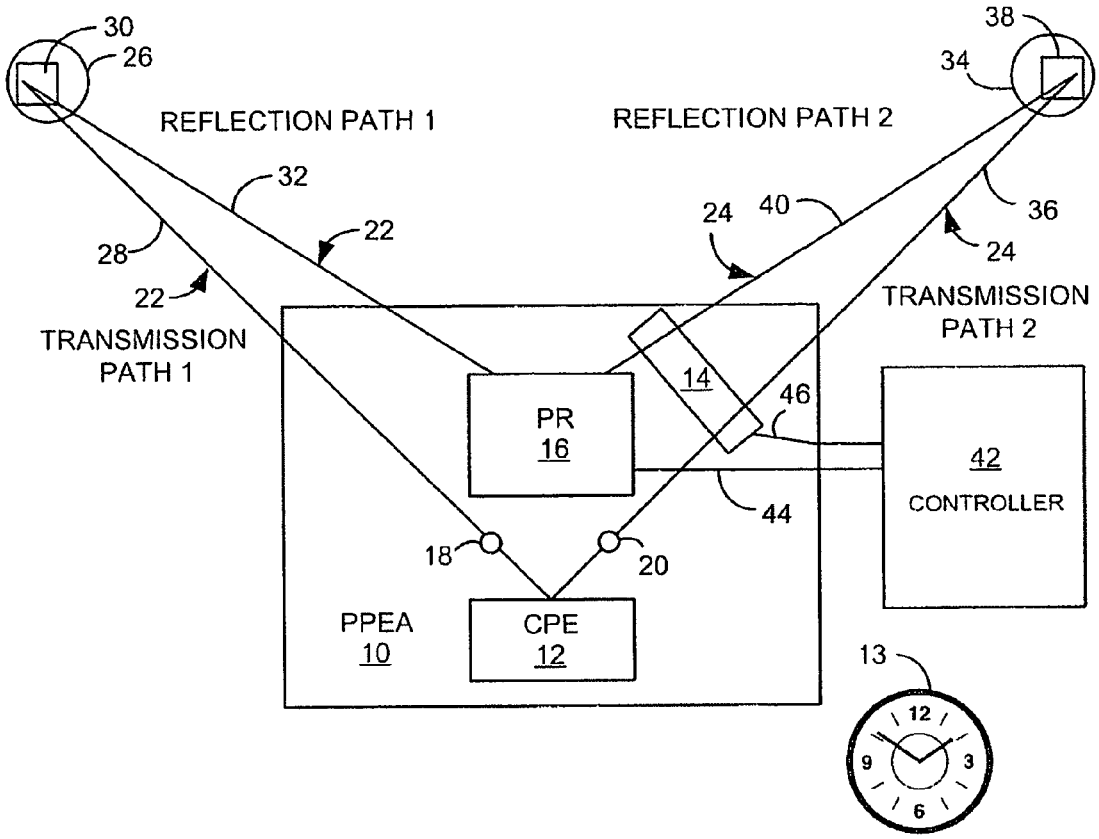
FIG. 1 is a block diagram of an embodiment of a particle path equalizer apparatus (PPEA) and two separated clocks.

FIG. 1 illustrates a particle path equalizer apparatus (PPEA) 10, which in some embodiments can be used for, among other things, synchronizing distant clocks. The configuration illustrated in FIG. 1 represents the initialization phase of the distant clock synchronization. The PPEA 10 includes a correlated particle emitter (CPE) 12, a variable particle delay element 14, and a particle receiver 16. The CPE 12 emits at least two correlated particles 18 and 20. The correlated particles 18 and 20 are quantum mechanically correlated such that there is a known, or a quantum mechanically predictable, relationship between their respective emission times or creation times. For the purposes of this disclosure the emission time for a particle is defined as the time at which the particle is emitted from the CPE 12 according to a reference clock 13 that is inertial with respect to the PPEA 10. For the purposes of this disclosure the creation time for a particle is defined as the time at which the particle is created in the CPE 12 according to the reference clock 13. In some embodiments, the CPE 12 emits streams of correlated particles, and consequently, the correlated particles 18 and 20 are in particle streams 22 and 24, respectively.

Conceptually, the reference clock 13 is an idealized clock that does not suffer from imperfections of hardware, i.e., the reference clock 13 keeps perfect or proper time. Time measured with respect to the reference clock 13 is referred to as coordinate time, (t), which is a global quantity, which is associated with the metric of space-time, $g_{ij}$, and enters into the definition of the system of 4-dimensional space-time coordinates.

Those skilled in the art understand the wave particle duality principle elucidated by DeBroglie. Consequently, the correlated particles 18 and 20 are both particles and waves, and the particle streams 22 and 24 are both streams of particles and beams of waves.

The particle stream 22 is directed to a first target 26 along a transmission path (T1) 28. The first target 26 includes a particle reflector 30, and during this initialization, the particle reflector 30 reflects the incident particle stream 22. Upon reflection, the particle stream 22 travels along a reflection path (R1) 32 to the particle receiver 16.

The particle stream 24 travels from the CPE 12 to a second target 34 along a second transmission path (T2) 36. The second target 34 includes a particle reflector 38, and during initialization, the particle stream 24 is reflected by the particle reflector 38 along a second reflection path (R2) 40. In some embodiments, the particle reflectors 30 and 38 are optical devices such as corner cube reflectors or mirrors. It should be noted that in some embodiments, the particle reflectors 30 and 38 are not 100% reflective.

The transmission path 36 has three legs: (1) from the CPE 12 to the variable particle delay element 14; (2) through the variable particle delay element 14; and (3) from the variable particle delay element 14 to the second target 34. Similarly, the reflection path (R2) 40 has three legs: (1) from the second target 34 to the variable particle delay element 14; (2) through the variable particle delay element 14; and (3) from the variable particle delay element 14 to the particle receiver 16.

The particle receiver 16 receives particle streams 22 and 24. In some embodiments, the particle receiver 16 measures the amount of correlation between received particles carried by the particle streams 22 and 24. For example, in one embodiment, the particles 18 and 20 are biphotons (correlated or entangled photon pairs, such as are produced by the process of spontaneous parametric down-conversion (SPDC) when a non-linear crystal is pumped by a laser) and the particle receiver 16 is a Hong-Ou-Mandel (HOM) interferometer, which measures the amount of interference (i.e., two-photon coincident counting rate) between correlated biphotons. The destructive interference between correlated biphotons is a maximum (i.e., minimum in the two-photon coincident counting rate) when the optical paths (T1+R1) and (T2+R2) are the same.

A controller 42 is in communication with the PPEA 10 via electrical connectors 44 and 46. Electrical connector 44 carries electrical signals from the particle receiver 16 to the controller 42. Using the signals from the particle receiver 16, the controller 42 provides control signals to the variable particle delay element 14 via electrical connector 46. The variable particle delay element 14 responds to the control signals to change, or maintain, the particle path through the variable particle delay element 14, i.e., to change, or maintain, the time that it takes the particle 20 to traverse the variable particle delay element 14. In some embodiments, the variable particle delay element 14 is adapted to vary its index of refraction, thereby providing variable delay for light waves (photons).

It should be noted that for a given configuration of the variable particle delay element 14, the time to traverse the variable particle delay element 14 is approximately independent of direction. In other words, for a given configuration, the transmission lag through the variable particle delay element 14 is approximately the same as the reflection leg through the variable particle delay element 14. Furthermore, it should be noted that in a preferred embodiment, the correlated particle emitter 12 and the particle receiver 16 are disposed such that they are approximately coincident. By having the correlated particle emitter 12 approximately coincident with the particle receiver 14, the time of flight along the transmission paths (T1, T2) 28 and 36 is approximately equal to the time of flight along the reflection paths (R1, R2) 32 and 40, respectively. Generally, the transmission paths (T1, T2) 28 and 36 are spatially much greater than the physical separation of the correlated particle emitter 12 and the particle receiver 16, and consequently, for all practical purposes the particle receiver 16 and correlated particle emitter 12 appear to be coincident as viewed from the targets 26 and 34.

In one embodiment, the components of the PPEA 10 are disposed on a microchip, which includes the necessary circuitry for providing communication paths between the components. In other components, the components are separate modules. Those skilled in the art are familiar with networking of the components such that power and signals are provided to the necessary components.

Generally, the controller 42 is a processing device that can include any custom made or commercially available processor, a central processing unit (CPU) or an auxiliary processor among several processors associated with the computer system, a semiconductor based microprocessor (in the form of a microchip), a macroprocessor, one or more application specific integrated circuits (ASICs), a plurality of suitably configured digital logic gates, and other well known electrical configurations comprising discrete elements both individually and in various combinations to coordinate the overall operation of the computing system.

Figure 2:
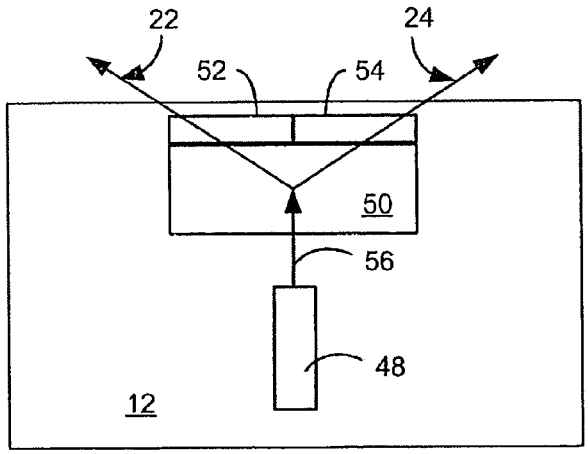
FIG. 2 is a block diagram of an embodiment of a correlated particle emitter.

FIG. 2 is a block diagram of the correlated particle emitter 12 for an embodiment that employs biphotons. The correlated particle emitter 12 includes a laser 48, a parametric down converter 50, and tuners 52 and 54. The laser 48 pumps a laser beam 56 into the parametric down converter 50. The parametric down converter 50 generates/creates biphotons (correlated or entangled photon pairs) from the photons in the laser beam 56. Those skilled in the art know that biphotons are a pair of photons that are created simultaneously from a single photon. Because both energy and momentum of the incident laser beam 56 are conserved, the parametric down converter 50 produces/creates a pair of correlated particles 18 and 20 from a single photon in the laser beam 56. Consequently, the laser beam 56 is transformed into the particle streams (laser beams) 22 and 24 by the parametric down converter 50.

The tuners 52 and 54 receive particle streams (laser beams) 22 and 24, respectively. The tuner 52 directs particle stream (laser beam) 22 along transmission path (T1) 28, and the tuner 54 directs particle stream (laser beam) 24 along transmission path (T2) 36. The tuners 52 and 54 are comprised of mirrors and other optical devices known to those skilled in the art.

In some embodiments, the laser 48 is a continuous wave laser such as an argon-ion laser oscillating at 351.1 nm, and the parametric down converter 50 is a crystal that lacks inversion symmetry. Examples of crystals used in parametric down conversion are a barium beta borate or a potassium dihydrogen phosphate crystal.

Figure 3:
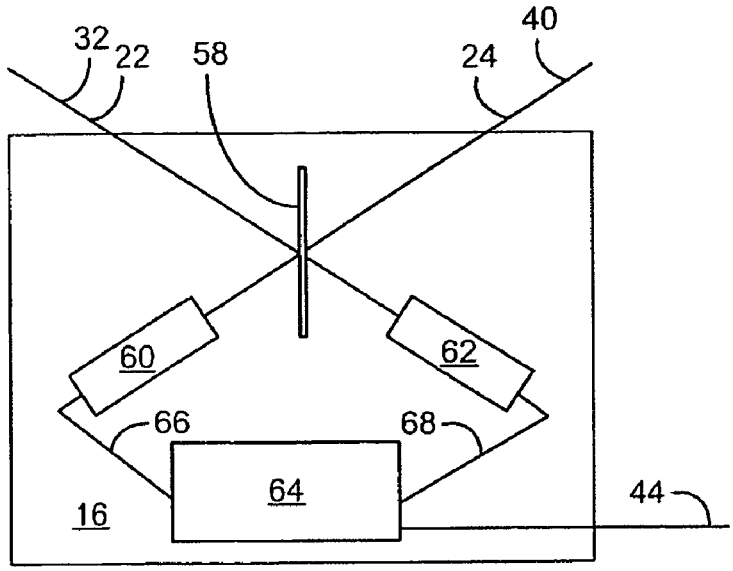
FIG. 3 is a block diagram of an embodiment of a particle receiver.

FIG. 3 illustrates components of the particle receiver 16 when the particle receiver is an HOM interferometer. The particle receiver 16 includes a beam splitter 58, photon detectors 60 and 62, and coincidence analyzer 64. The beam splitter 58 is adapted to have equal reflectance and transmittance so that either photon detector 60 or 62 is equally or likely to receive either one of the particles (photon) 18 or 20. The photon detectors 60 and 62 are in communication with the coincidence analyzer 64 via communication links 66 and 68, respectively. Each of the photon detectors 60 and 62 signals the coincidence analyzer 64 when they detect a particle.

The coincidence analyzer 64 determines the number of coincidences, i.e., the number of particles that are detected at the photon detectors 60 and 62 per unit time. When the sum of the transmission path 28 and reflection path 32 (T1+R1) approximately equals the sum of the transmission path 36 and reflection path 40 (T2+R2), then, for the case of biphotons, the particles 18 and 20 arrive at the particle receiver 16 approximately simultaneously and experience destructive interference. The coincidence analyzer 64 communicates the number of coincidences to the controller 42 via the electrical connector 44.

Figure 4:
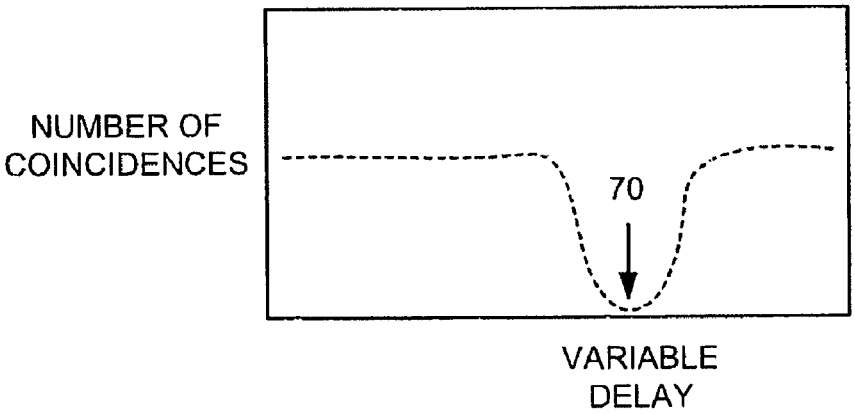
FIG. 4 is a plot of number of coincidences versus particle delay.

FIG. 4 is a plot of the number of coincidences, i.e., the number of photons detected, as a function of variable delay. The number of coincidences exhibits a minimum 70 which corresponds with the sum of the transmission path 28 and reflection path 32 (T1+R1) approximately equaling the sum of the transmission path 36 and the reflection path 40 (T2+R2). In some embodiments of the system, a maximum in the two-photon coincidence counting rates can be observed and used for synchronization of the clocks.

Figure 5:
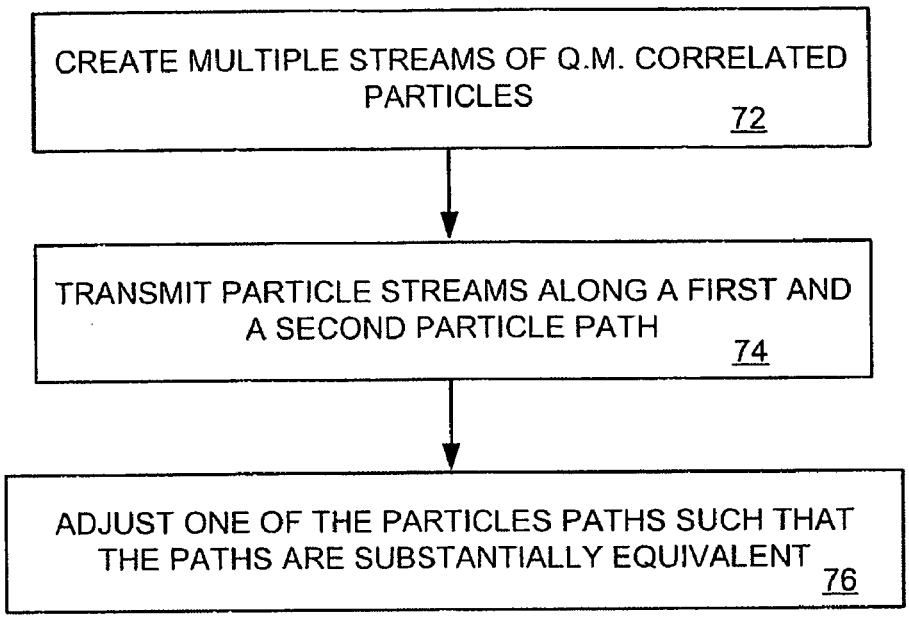
FIG. 5 is an exemplary flow chart of a method for creating substantially equivalent particle paths.

FIG. 5 illustrates an exemplary flow chart for steps taken to initialize synchronization of distal clocks. In step 72, multiple streams of quantum mechanically correlated particles are created. A given particle in one stream has a quantum mechanically correlated particle in another stream. The correlation between two or more particles enables measurements, or observables, on and between the correlated particles such as interference. Although, one embodiment is described in terms of employing biphotons, this is done merely for exemplary purposes, and in some embodiments, different correlated particles could be employed. Next, in step 74, streams of correlated particles are transmitted along separate paths. Particles in one stream are transmitted along transmission path (T1) 28 and reflection path (R1) 32, and particles in another stream are transmitted along transmission path (T2) 36 and reflection path (R2) 40.

Next, in step 76, the particle path of one of the streams is adjusted such that the paths are substantially equivalent. It should be noted that the two transmission and reflective paths (28, 32) and (36, 40) are substantially temporally equivalent, i.e., the time of flight from the correlated particle emitter 12 to the particle receiver 16 is substantially equivalent on the two complete paths (28, 32) and (36, 40).

Figure 6:
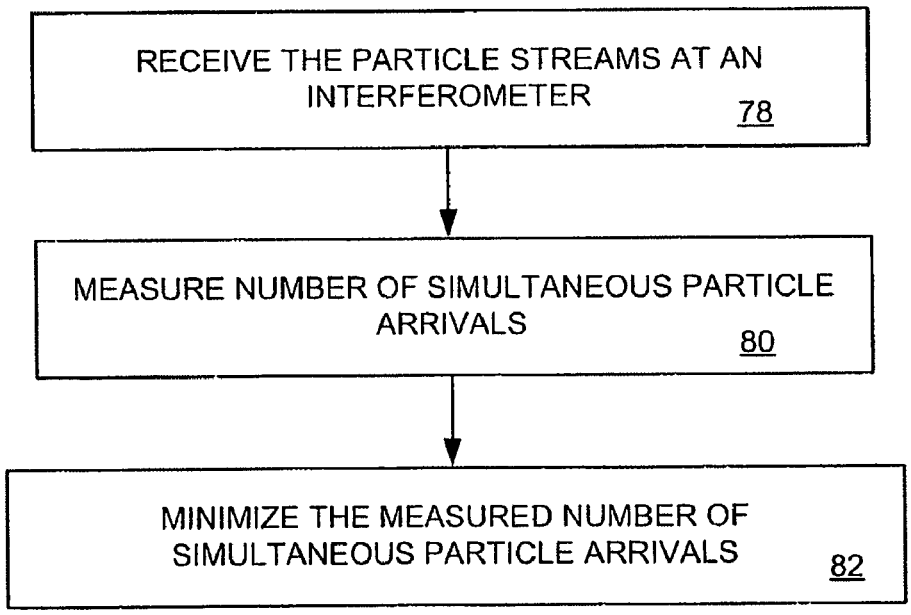
FIG. 6 is an exemplary flow chart of a method for creating substantially equivalent particle paths using biphotons.

FIG. 6 illustrates exemplary steps that are taken during step 76 for correlated particles such as biphotons. In step 78, streams of correlated particles are received at an interferometer. Next in step 80, the number of coincidences, i.e., the number of simultaneous arrivals of biphotons, is determined.

Next, in step 82, the number of coincidences is minimized. The controller 42 controls the variable path delay element 14 such that the variable path delay element 14 is configured to minimize the number of coincidences.

Clock Synchronization

Figure 7:
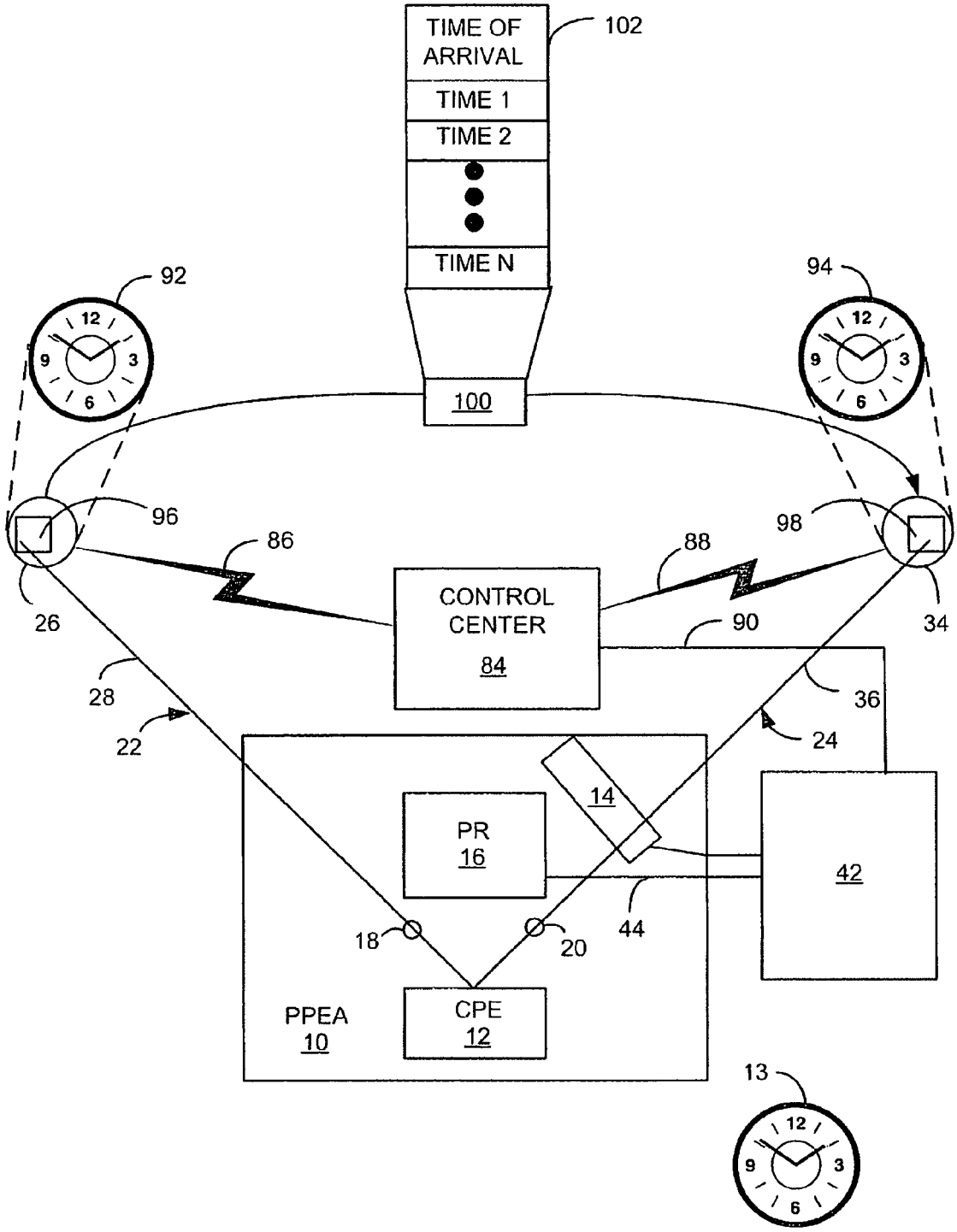
FIG. 7 is a block diagram of an embodiment of a particle path equalizer apparatus (PPEA) synchronizing clocks on two satellites.

Referring to FIG. 7, in some embodiments, the targets 26 and 34 are satellites, which are in communication with a satellite control center 84. The satellite control center 84 includes the necessary software, hardware, and personnel for controlling the targets/satellites 26 and 34 and for communicating with the targets/satellites 26 and 34 over communication links 86 and 88, respectively. The controller 42 signals the satellite control center 84, via a communication link 90, when the transmission and reflection paths (28, 32) and (36, 40) (See FIG. 1) have been substantially equalized. The satellite control center 84 then signals the targets/satellites 26 and 34 to commence with synchronizing their respective clocks 92 and 94.

The correlated particle emitter 12 emits particle streams 22 and 24, which in some embodiments are comprised of biphotons. The particle stream 22 travels along the transmission path (T1) 28 to the target/satellite 26, and the particle stream 24 travels along the transmission path (T2) 36 to the target/satellite 34. Responsive to the signal from the satellite control center 84, the targets/satellites 26 and 34 begin to collect particle arrival data for particles carried by the particle streams 22 and 24, respectively.

In the embodiment illustrated in FIG. 7, the particle reflectors 30 and 38 are not shown. The targets/satellites 26 and 34 adjust/move their respective particle reflectors 30 and 38 responsive to receiving a signal from the satellite control center 84, thereby exposing particle detectors 96 and 98, respectively, to the particle beams 22 and 24. In other embodiments, the particle reflectors 30 and 38 are not 100% reflective, and in that case, the particle detectors 96 and 98 are partially exposed to the particle beams 22 and 24 without adjusting/moving the particle reflectors 30 and 38. In some embodiments, the particle detectors 96 and 98 are photodetectors.

The particle detectors 96 and 98 detect the arrival of particles and record the arrival times of the particles with respect to the clocks 92 and 94, respectively. Photon arrival time data at satellite 26 is given by a set of numbers $\{\tau_j^{(92)}\}$, where j=1, N, which is typically about 1 million data points, which are recorded in a particle arrival table 100. The satellite 34 also records photon arrival time data in a particle arrival table (not shown), and the arrival times of photons at the satellite 34 are denoted by the set of number $\{\tau_j^{(94)}\}$, where j=1, N. Typically, the intensity of particle streams 22 and 24 are such that about 1 million data points are accumulated at the targets/satellites 26 and 34 within approximately one second or so, or fast enough such that mechanical imperfections in the clocks 92 and 94 can be ignored, or that motion of the two clocks can be ignored, or, a separate correaction can be made for clock motion. The data accumulation occurs fast enough that the clocks 92 and 94 appear to be ideal clocks having "proper time", or alternatively, that a clock correaction can be applied to the time kept by the real hardware clock to make it effectively keep proper time to the needed accuracy. On the world line of clock 92, the "proper time" elapsed between the reception of the first particle ($t_l^{(92)}$) and the $k^{th}$ particle ($t_k^{(92)}$) recorded in the particle arrival table 100 is given by: $\tau_k^{(92)}+\Delta\tau^{(92)}=t_k^{(92)}-t_l^{(92)}$, where $\tau_k^{(92)}$ is the time that the $k^{th}$ particle arrived as measured by clock 92, and $\Delta\tau^{(92)}$ is the clock correaction that relates coordinate time (t) to "proper time" for clock 92. Similarly, on the world line of clock 94, the "proper time" elapsed between the reception of the first particle ($t_l^{(94)}$) and the $k^{th}$ particle ($t_k^{(94)}$) recorded in the particle arrival table of target/satellite 34 is given by: $\tau_k^{(94)}+\Delta\tau^{(94)}=t_k^{(94)}-t_l^{(94)}$, where $\tau_k^{(94)}$ is the time that the $k^{th}$ particle arrived as measured by clock 94, and $\tau\tau^{(94)}$ is the clock correaction that relates coordinate time (t) to "proper time" for clock 94.

After a predetermined amount of time or a predetermined amount of data has been collected, the target/satellite 26 provides the target/satellite 34 with a particle arrival table 100. The particle arrival table 100 includes the particle arrive time data 102 for target/satellite 26. Typically, the particle arrival table 100 may include about 1,000,000 data points, i.e., arrival times. The particle arrival table 100 may be transmitted directly between targets/satellites 26 and 34 or through one or more intermediaries such as the satellite control center 84.

Photons that are coincident at clock 92 and 94 are defined to be those that are simultaneous in the inertial system of space-time coordinates which is defined by the frame of reference of the particle (biphoton) emitter.

Figure 8:
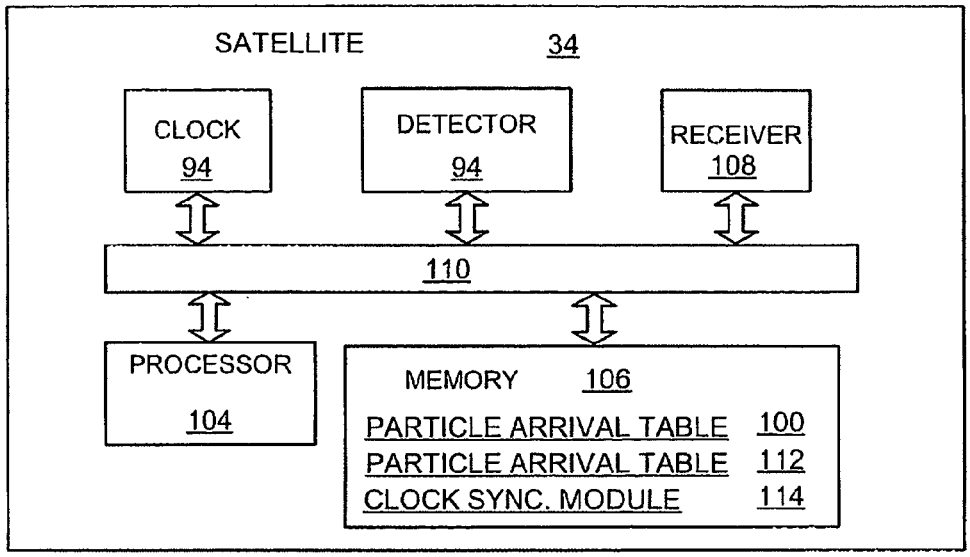
FIG. 8 is a block diagram of an embodiment of selected components of a satellite.

FIG. 8 is a block diagram of selected components of satellite 34. In addition to the clock 94 and the detector 98, satellite 34 includes a processor 104, a memory 106, and a receiver 108, which are coupled to a bus 110. The receiver 94 receives messages/signals from the satellite control center 84 and provides the processor 104 with the messages/signals. The receiver 108 also receives the particle arrival table 100, which is provided to the processor 104 and stored in the memory 106.

The memory 106 includes a particle arrival table 112, which is a recordation of particle arrival times at the satellite 34 as determined by the detector 98 using clock 94, and a clock synchronization module 114. The processor 104 implements the clock synchronization module 114 using the particle arrival tables 100 and 112 to synchronize the clock 94 to the clock 92. The clock synchronization module 114 includes the logic for calculating a correlation between the particle arrival times using the particle arrival tables 100 and 112 and for determining and applying an offset for clock 94. In some embodiments, the clock synchronization module also includes the logic for controlling the particle reflector 30.

Figure 9:
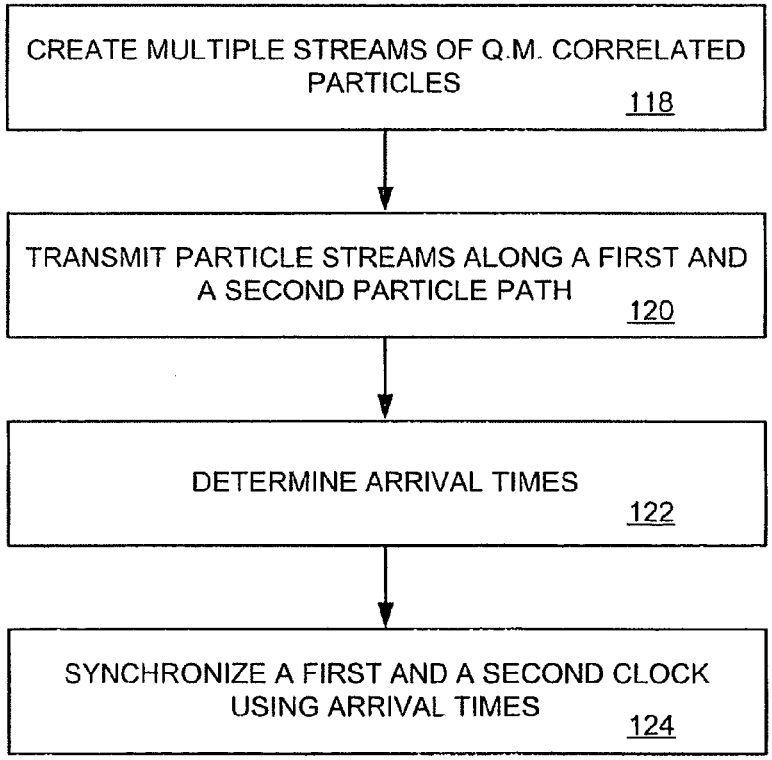
FIG. 9 is an exemplary flow chart of a method for synchronizing two separated clocks.

FIG. 9 is a flow chart of exemplary steps taken in clock synchronization. For the sake of clarity this description illustrates synchronizing two clocks, but in some embodiments, more than two clocks are synchronized. Those skilled in the art would know how to generalize the steps for more than two clocks.

In step 118, multiple streams of quantum mechanically correlated particles are created, and next in step 120, the streams of quantum mechanically correlated particles are transmitted along transmission paths (T1) 28 and (T2) 36.

Next in step 122, the targets/satellites 26 and 34 receive the streams of correlated particles. The target/satellites 26 and 34 use their clocks 92 and 94, respectively, to determine the arrival times of the particles.

Next in step 124, the clock 94 is synchronized with the clock 92 using arrival times of particles at the target/satellite 26.

Figure 10:
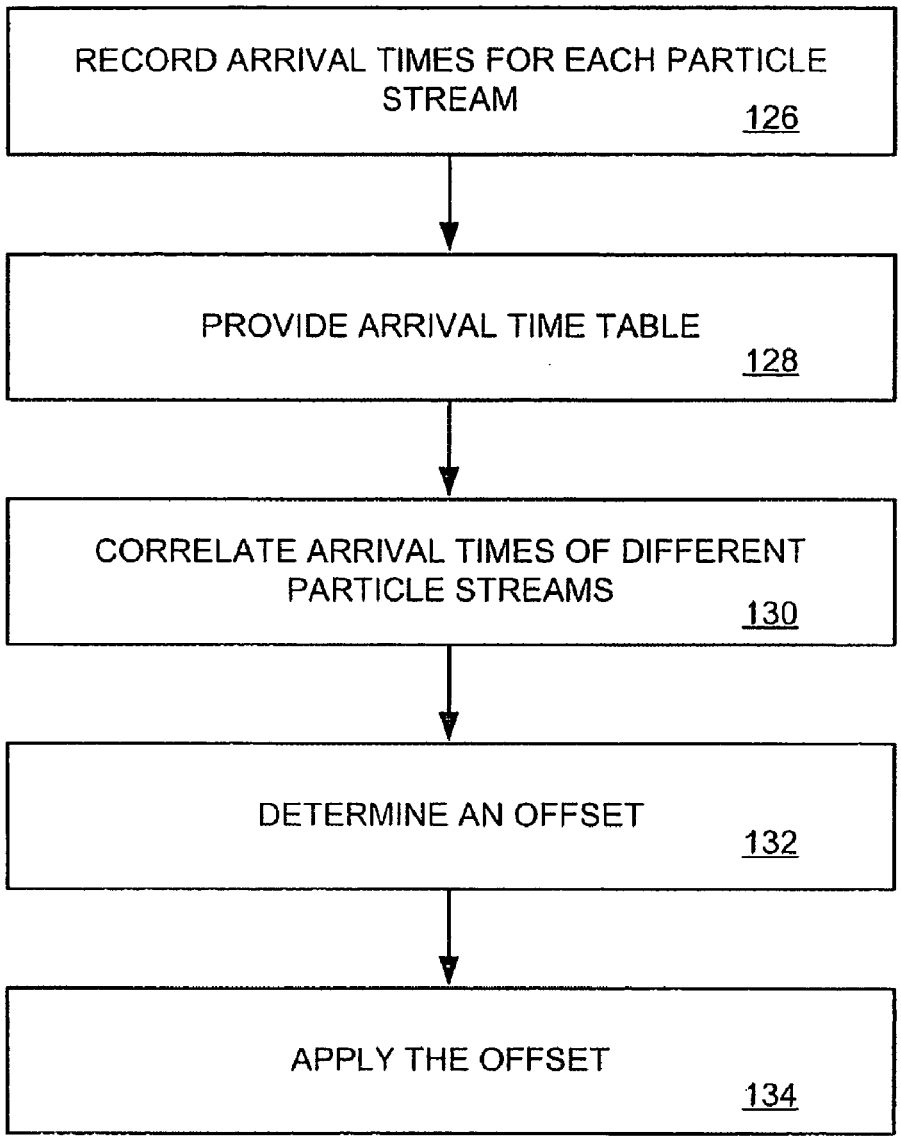
FIG. 10 is an exemplary flow chart of a method for synchronizing two separated clocks using particle arrival tables.

FIG. 10 further illustrates exemplary steps that are implemented during steps 122 and 124. In step 126, the target/satellites 26 and 34 record particle arrival times in their respective particle arrival tables 100. Next in step 128, the particle arrival table 100 of target/satellite 26 is provided to the target/satellite 34.

Next in step 130, the target/satellite 34 correlates the arrival times of the different particle streams using its particle arrival table (not shown) and the particle arrival time table 100 of the target/satellite 26. The correlation function $g(\tau)$ is computed $$g(\tau)=\frac{1}{N}\sum_{i=1}^{N}\sum_{j=1}^{N}\delta(\tau-\tau_j^{(92)}+\tau_i^{(94)})$$

where N is the number of detected particles, $\tau_j^{(92)}$ is the arrival time, as measured by clock 92, of the $j^{th}$ particle, $\tau_i^{(94)}$ is the arrival time, as measured by clock 94, of the $i^{th}$ particle, and $\delta$ is the Dirac delta function.

Next, in step 132, an offset ($\tau_0$) for clock 94 is determined. The offset is given by the maximum in the correlation function $g(\tau)$.

Next, in step 134, the offset is applied to clock 94. After applying the offset, clocks 92 and 94 are synchronized. It should be noted that the clocks 92 and 94 are synchronized with respect to each other, but they are not necessarily synchronized with respect to a reference clock (not shown) that is inertial with respect to the PPEA 10.

It should be noted, that in the case where the particles 18 and 20 are biphotons, the clocks 92 and 94 are synchronized with an accuracy in the range of picoseconds to femtoseconds, depending on the particular design of system components.

It should be emphasized that the above-described embodiments are merely possible examples of implementations. Many variations and modifications may be made to the above-described embodiments. All such modifications and variations are intended to be included herein within the scope of this disclosure and the present invention and protected by the following claims.

What is claimed is:

1. A method of synchronizing a first clock with a second clock, wherein the first and second clocks are geographically separated clocks, the method comprising:

transmitting along a first particle path a first stream of particles to a target having the first clock;

transmitting along a second particle path a second stream of particles to a second target having the second clock;

determining an offset for the first clock based upon arrival times of particles in the first stream of particles at the first target and upon arrival times of particles in the second stream of particles at the second target;

applying the offset to the first clock; and wherein a given particle in the first stream of particles is quantum mechanically correlated with a particular particle in the second stream of particles.

2. The method of claim 1, further including:

making the first particle path substantially equivalent to the second particle path.

3. The method of claim 1, further including:

correlating the arrival times of the particles in the first stream of particles at the first target with the arrival times of the particles in the second stream of particles at the second target.

4. The method of claim 3, wherein the arrival times of particles at the first target are measured relative to the first clock, and the arrival times of the particles at the second target are measured relative to the second clock.

5. The method of claim 1, further including:

recording in a particle arrival table the arrival times of particles in the second stream of particles at the second target; and providing the first target with the particle arrival table.

6. The method of claim 5, further including:

recording in a second particle arrival table the arrival times of particles in the first stream of particles at the first target;

correlating the arrival times recorded in the first and second particle arrival table's.

7. The method of claim 1, wherein the given particle and the particular particle are a biphoton pair.

8. An apparatus for synchronizing a first clock with a second clock, the apparatus comprising:

a memory having a clock synchronization module stored therein; and a processor in communication with the memory, the processor being configured to implement the clock synchronization module to correlate a first particle arrival table with a second particle arrival table to calculate an offset for a first clock, wherein the first particle arrival table includes arrival times for a first set of particles as measured by the first clock, and the second particle arrival table includes arrival times for a second set of particles as measured by a second clock, and wherein the first set of particles includes particles that are quantum mechanically correlated with particles included in the second set of particles.

9. The apparatus of claim 8, wherein the correlation between particle arrival times in the first and second particle arrival tables is given by:

$$g(\tau) = \frac{1}{N}\sum_{i=1}^{N}\sum_{j=1}^{N}\delta(\tau - \tau_j^{(2)} + \tau_i^{(1)})$$

where N is the number of detected particles, $\tau_j^{(1)}$ is the arrival time, as measured by the first clock of the $j^{th}$ particle, $\tau_i^{(2)}$ is the arrival time, as measured by second clock 94 of the $i^{th}$ particle, and $\delta$ is the Dirac delta function.

10. The apparatus of claim 9, wherein the offset is given by the equation: $\tau=\Delta\tau^{(1)}-\Delta\tau^{(2)}$, wherein $\Delta\tau^{(1)}$ is the clock correaction that relates coordinate time to the time of the first clock, and wherein $\Delta\tau^{(2)}$ is the clock correaction that relates coordinate time to the second clock.

11. A system for synchronizing a first clock with a second clock, wherein the first and second clocks are geographically separated, the system comprising:

a correlated particle emitter that emits a first particle stream and a second particle stream, wherein particles in the first and second particle streams are quantum mechanically correlated;

a first target having the first clock and a first particle detector, wherein the first target uses the first clock and the first particle detector to determine arrival times of particles included in the first particle stream; and a second target having the second clock and a second particle detector, wherein the second target uses the second clock and the second particle detector to determine arrival times of particles included in the first particle stream.

12. The system of claim 11, further including:

a first particle arrival table, which includes arrival times of particles in the first particle stream at the first target, wherein the arrival times are measured relative to the first clock; and a second particle arrival table, which includes arrival times of particles in the second particle stream at the second target, wherein the arrival times are measured relative to the second clock.

13. The system of claim 12, wherein the second target further includes:

a processor that implements a clock synchronization module to correlate the first particle arrival table with the second particle arrival table to determine a temporal offset for second clock.

14. The system of claim 13, wherein the clock synchronization module includes logic for applying the temporal offset to the second clock.

15. The system of claim 11, wherein the first target includes a first particle reflector, and the second target includes a second particle reflector, and further including:

a particle receiver that receives particles in the first and second particle streams that have been reflected by the first and second particle reflectors, and wherein the particle receiver measures a quantum mechanical correlation between reflected particles in the first particle stream and the second particle stream.

16. The system of claim 15, wherein the correlated particle emitter emits correlated particle streams that are comprised of biphotons, and the particle receiver is an Hong-Ou-Mandel (HOM) interferometer.

17. The system of claim 15, further including:

a variable particle delay element, wherein the first particle stream traverses the variable particle delay element; and a controller in communication with the particle receiver and the variable particle delay element, wherein the controller receives information from the particle receiver regarding the measured quantum mechanical correlation and uses the information to set the variable particle delay element.

18. The system of claim 17, wherein the variable particle delay element is set such that the quantum correlation is approximately at an extremum.

19. A system for synchronizing a first clock with a second clock, wherein the first and second clocks are geographically separated, the system comprising:

a correlated particle emitter means for emitting a first particle stream and a second particle stream of particles, wherein particles in the first and second particle streams are quantum mechanically correlated;

a first target having the first clock and a first particle detector means, wherein the first target uses the first clock and the first particle detector means to determine arrival times of particles included in the first particle stream; and a second target having the second clock and a second particle detect or means, wherein the second target uses the second clock and the second particle detector means to determine arrival times of particles included in the first particle stream.

20. The system of claim 19, further including:

a first means for recording particle arrival times of particles in the first particle stream at the first target, wherein the arrival times are measured relative to the first clock; and a second means for recording particle arrival times of particles in the second particle stream at the second target, wherein the arrival times are measured relative to the second clock.

21. The system of claim 20, wherein the second target further includes:

means for correlating particle arrival times of particles in the first particle stream with particle arrival times of particles in the second particle stream; and means for determining a temporal offset for the second clock using the correlation of the particle arrival times.

22. The system of claim 21, further including:

means for applying the temporal offset to the second clock.

23. The system of claim 19, wherein the first target includes a first particle reflector means, and the second target includes a second particle reflector means, and further including:

a particle receiver means for receiving particles in the first and second particle streams that have been reflected by the first and second particle reflectors means, and wherein the particle receiver means measures a quantum mechanical correlation between reflected particles in the first particle stream and the second particle stream.

24. The system of claim 23, wherein the correlated particle emitter means emits correlated particle streams that are comprised of biphotons, and the particle receiver means is an Hong-Ou-Mandel (HOM) interferometer.

25. The system of claim 23, further including:

a variable particle delay means for introducing a variable delay for the first particle stream; and a means for controlling the particle receiver means and the variable particle delay means, wherein the controller means receives information from the particle receiver means regarding the measured quantum mechanical correlation and uses the information to set the delay introduced by the variable particle delay means.

26. The system of claim 25, wherein the variable particle delay means is set such that the quantum correlation is approximately at an extremum.

* * * * *